United States Patent [19]

Absher

[11] 3,935,666

[45] Feb. 3, 1976

[54] FULCRUM TOY ASSEMBLY

[75] Inventor: Eugene L. Absher, Anaheim, Calif.

[73] Assignee: Alpha Nova Development Company, Santa Ana, Calif.

[22] Filed: Nov. 7, 1974

[21] Appl. No.: 521,639

[52] U.S. Cl. ..... 46/131

[51] Int. Cl.[2] ..... A63H 13/12

[58] Field of Search ..... 46/1 R, 100, 131, 150

[56] References Cited

UNITED STATES PATENTS

| | | | |
|---|---|---|---|
| 2,881,560 | 4/1959 | Dawson | 46/131 |
| 3,516,193 | 6/1970 | Engleman | 46/1 R |

*Primary Examiner*—Louis G. Mancene
*Assistant Examiner*—Robert F. Cutting
*Attorney, Agent, or Firm*—R. A. DiMeo

[57] ABSTRACT

A fulcrum toy assembly whereby a primary body element is provided with pointed contact points so as to prevent excursion thereof upon its support base, a second body element which has its center of gravity disposed below the pointed contact points of the primary body elements is attached to a resilient wire member, said resilient wire member in turn being connected with a second resilient wire member attached to said primary body element so that upon the application of a slight force to the primary body element, said primary body element will rock in a vertical plane while simultaneously oscillating said second body element in a horizontal as well as a vertical plane.

9 Claims, 3 Drawing Figures

FIG. 1
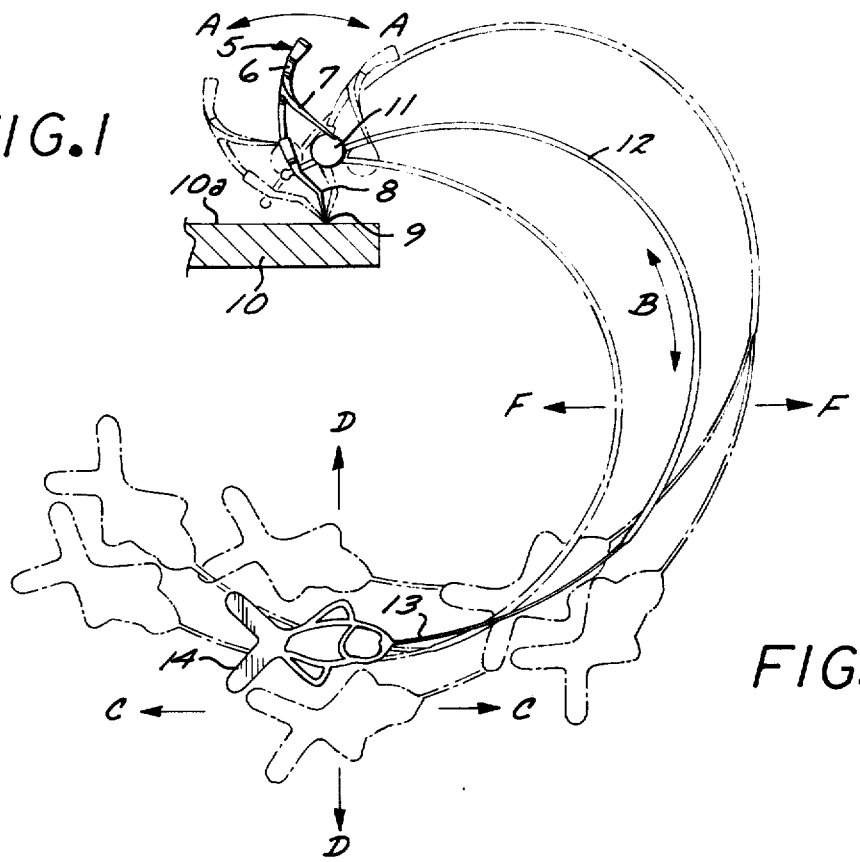
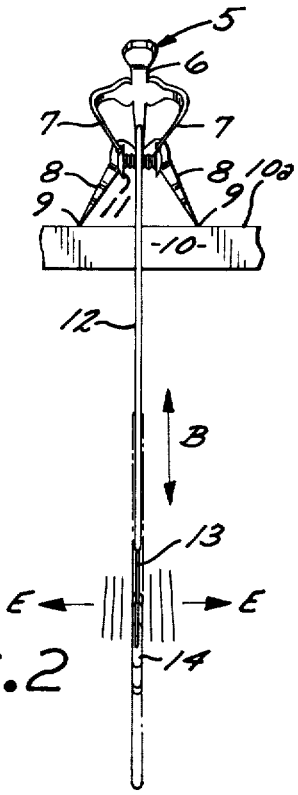
FIG. 2
FIG. 3
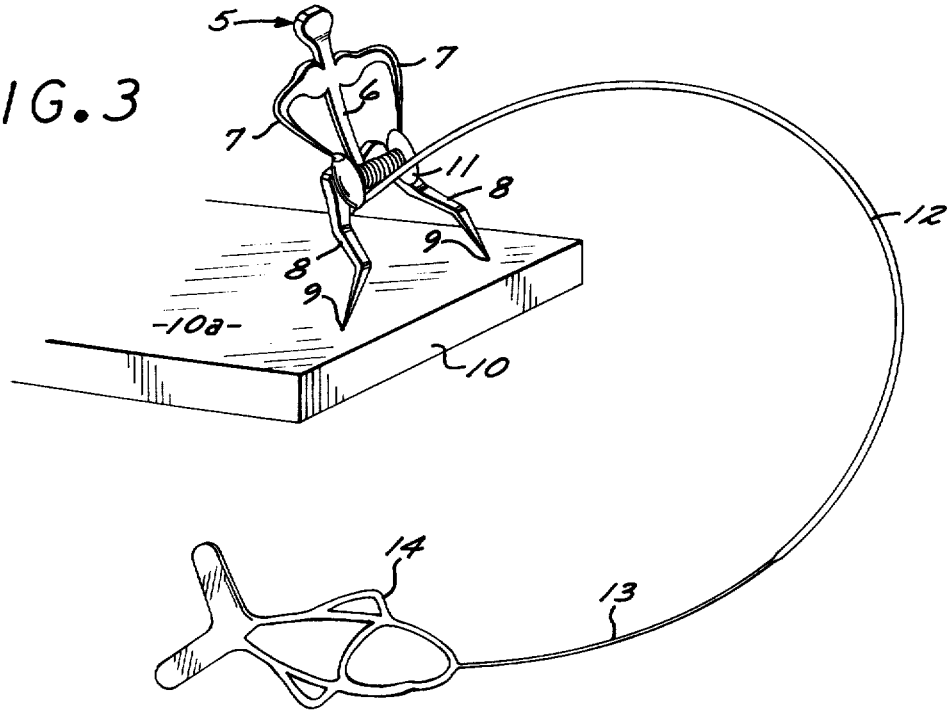

FULCRUM TOY ASSEMBLY

Previous oscillating or fulcrumed toys were prone to excursion; that is, the fulcrum moved about the supporting base causing the oscillating member to become inhibited by the base upon which the fulcrum was seated thereby restricting or preventing further oscillation thereof.

The fulcrum toy assembly of the instant invention is comprised of a simulated figure of a fisherman having feet formed into pointed balancing tips and an extended wire pole formed in a predetermined arc from which extends an arcuated resilient wire simulating a fishing line. The fishing line has a fish attached thereto counterbalancing the fisherman figure whereby the fish is initially situated so that its center of gravity is disposed below the fulcrum so that upon the application of a slight force to the fisherman, said fish is simultaneously oscillated and arcuated to simulate a fisherman landing a hooked fish.

In the instant invention the fisherman figure is formed not only to provide a predetermined balance to the counterbalancing fish, but is also provided with feet which are pointed to form balancing tips and thereby, fulcrum points, which are not subject to excursion upon the supporting base.

The principal object of the invention is to provide an entertaining fulcrum toy assembly which is not subject to excursion upon its supporting base.

Another object is to provide a fulcrum toy assembly which due to its unique fulcrum will oscillate for prolonged periods of time without excursion upon the supporting base.

Still another object is to provide a dynamically stable fulcrum toy assembly which simulates a fisherman attempting to land a hooked fish.

Yet another object is to provide a fulcrum toy assembly which is devoid of moving parts and is economical to manufacture.

Other objects and advantages will become apparent from the following description taken in conjunction with the accompanying drawings, in which:

FIG. 1 is a side elevational view of the fulcrum toy assembly showing the vertical oscillation of the simulated fishing line and fish toy in dotted lines;

FIG. 2 is a front elevational view of the fulcrum toy assembly of FIG. 1 showing the horizontal oscillation of the simulated fish in dotted lines; and FIG. 3 is a perspective view of the fulcrum toy assembly of FIG. 1

Referring to FIGS. 1 through 3, reference numeral 5 represents generally the primary body element of a simulated fisherman having a body portion 6 from which extend arm elements 7 and a pair of leg elements 8. Each leg element 8 is tapered to form a point 9 at its extremity so that the primary body element is in point contact only at two separate locations on the top surface 10*a* of support base 10. These contact points provide balancing tips as well as fulcrum points and prevent excursion of the primary body during oscillation of the fulcrum toy assembly.

Interconnecting arm elements 7 is a reel element 11 which simulates a fishing reel and from which extends a resilient wire element 12 in a predetermined arcuate form so as to simulate a fishing pole.

Secured to wire element 12 is a second resilient wire element 13 simulating a fishing line which is of different composition than wire element 12 so that wire element 13 is more flexible than wire element 12. This difference in wire element composition results in a difference in harmonics being created between the wire elements during the oscillation process thereby providing a horizontal as well as vertical oscillation of wire element 13 and concomitantly the second body element 14. Wire element 12 oscillates in a vertical plane only, and then only slightly with respect to wire element 13. The double oscillation of wire element 13 and second body element 14 while wire element 12 merely oscillates slightly in the vertical plane adds a higher degree of realism and entertainment to the fulcrum toy assembly of the instant invention.

Second body element 14 is secured to wire element 13 as aforesaid and simulates a fish which has its center of gravity disposed below the fulcrum provided by leg points 9 engaging the top surface 10*a* of support base 10. This second body element 14 provides a counterbalance to the primary element 5 as will hereinafter be more fully described.

Thus, upon the application of a slight horizontal force to primary body element 5, said primary body element will rock in a reciprocating pattern in a vertical plane as generally indicated by the Arrows A. Primary body element 5 rocks back and forth, wire elements 12 and 13 concomitantly oscillate in an arcuate pattern in a vertical plane (generally indicated by Arrows B), thereby simultaneously activating second body element 14 in a generally horizontal direction as indicated by Arrows C. Because of the shift of the center of gravity of the primary body element 5 due to its rocking motion, second body element 14 constantly counteracts to balance the assembly thereby continuing and abetting the rocking motion of the primary body element 5 through its interconnection therewith by wire elements 12 and 13.

Since wire element 13 is relatively more resilient than wire element 12, the resulting oscillation harmonics cause the second body element to simultaneously oscillate in a vertical plane (as designated generally by Arrows D) as well as in a horizontal plane as designated generally by Arrows E (see FIG. 2). These simultaneous actions of course cause wire element 13 to oscillate in a substantially horizontal plane as designated generally by Arrows F.

While one embodiment of the invention has been described, it is understood that the particular embodiment of the invention herein disclosed is for illustrative purposes only and that various changes may be made therein without departing from the principles of the invention.

I claim:

1. A fulcrum toy assembly comprising:

a primary body element provided with plurality of point contact means for engaging a support base thereby providing a fulcrum means which permits said primary body element to reciprocate in a vertical plane, said point contact means being a pair of spatially situated pointed elements positioned so as to be in a plane normal to the direction of reciprocation of the primary body element;

a plurality of resilient wire means extending forwardly and downwardly of said primary body element, said wire means being of different resiliences; and a second body element secured to said wire means, said second body element having its center of gravity below the fulcrum means formed by the point contact means of said primary body means in conjunction with said support base.

2. The fulcrum toy assembly described in claim 1 wherein the plurality of resilient wire means are a first and second flexible wire elements, the first wire element being secured to the primary body element and extending arcuately in a predetermined pattern forwardly and downwardly from the primary body element, and the second wire element is connected to the first wire element and continues the arcuate pattern of said first wire element, said second wire element being more resilient than the first wire element.

3. The fulcrum toy assembly as described in claim 2 wherein the forward end of the first wire element extends to at least the plane of the top surface of the support base.

4. The fulcrum toy assembly as described in claim 2 wherein when the primary body element is in a non-reciprocating position, the second body element is disposed in a vertical plane passing through the fulcrum means formed by the interrelationship of the point contact means provided by the primary body element and the support base.

5. The fulcrum toy assembly as described in claim 2 wherein when the primary body element is in a non-reciprocating position, the second body element is disposed rearwardly of a vertical plane passing through the fulcrum means formed by the interrelationship of the point contact means provided by the primary body element and the support base.

6. The fulcrum toy assembly as described in claim 2 wherein the primary body element is a simulated figure of a man and the second body element is a simulated figure of a fish.

7. The fulcrum toy assembly as described in claim 6 wherein the primary body element is provided with a pair of arms interconnected by a simulated fishing reel means.

8. The fulcrum toy assembly as described in claim 7 wherein the first wire element is secured to the simulated fishing reel means.

9. The fulcrum toy assembly as described in claim 6 wherein the point contact means are formed by the lower extremities of the legs of the simulated figure of the man.

* * * * *